US005209168A

United States Patent [19]

Chapron et al.

[11] Patent Number: 5,209,168

[45] Date of Patent: May 11, 1993

[54] SECURE CLOSURE SYSTEM FOR METAL CABINET DOORS

[75] Inventors: Claude Chapron, Longjumeau; Alain Chappot, Bretigny Sur Orge; Dominique Damas, Morigny Champigny, all of France

[73] Assignee: Compagnie Generale D'Automatisme CGA-HBS, France

[21] Appl. No.: 945,948

[22] Filed: Sep. 17, 1992

[30] Foreign Application Priority Data

Sep. 20, 1991 [FR] France ..... 91 11615

[51] Int. Cl.[5] ..... E05G 1/04

[52] U.S. Cl. ..... 109/59 T; 70/1.5; 70/123; 70/144; 70/418; 292/36; 292/50; 292/157; 292/DIG. 17; 312/216

[58] Field of Search ..... 70/1.5, 1.7, 109, 123, 70/144, 416, 418; 292/35, 38, 50, 157, 158, DIG. 17; 312/216, 221; 109/59 R, 59 T, 60

[56] References Cited

U.S. PATENT DOCUMENTS

| | | | |
|---|---|---|---|
| 2,859,470 | 11/1958 | McClung | 292/50 X |
| 2,879,725 | 3/1959 | Zuver | 109/59 |
| 3,175,873 | 3/1965 | Blomquist et al. | 312/216 X |
| 3,400,562 | 9/1968 | Bloss | 292/36 X |
| 4,266,488 | 5/1981 | Markham | 70/1.5 X |
| 4,477,130 | 10/1984 | Frantz | 312/216 X |
| 4,706,577 | 11/1987 | Jones | 70/1.5 X |

FOREIGN PATENT DOCUMENTS

| | | | |
|---|---|---|---|
| 12419 | of 1913 | United Kingdom | 70/1.5 |
| 342907 | 2/1931 | United Kingdom | 292/DIG. 17 |

*Primary Examiner*—Lloyd A. Gall
*Attorney, Agent, or Firm*—Sughrue, Mion, Zinn Macpeak & Seas

[57] ABSTRACT

A security system for a metal cabinet door comprises a latch adapted to be locked by a lock operating the latching members of the door. These comprise upper and lower strip members each having a plurality of hooks each of which, when the door is closed and latched, is engaged in an opening formed in a locking profiled member attached to the cabinet and at least one rotating sector whose rotation axis is perpendicular to the plane of the door. When the door is closed and latched the sector(s) enter an opening in a longitudinal member attached to the cabinet on the same side as the hinge(s). The sector is operated in the unlatching direction by the latch through a cable and in the latching direction by a return spring.

3 Claims, 4 Drawing Sheets

SECURE CLOSURE SYSTEM FOR METAL CABINET DOORS

BACKGROUND OF THE INVENTION

Field of the Invention

The present invention concerns a secure closure system for metal cabinet doors.

The invention applies to any cabinet to be protected, at least for some minimum period of time, against theft, such as an automatic public transport ticket dispenser.

SUMMARY OF THE INVENTION

The invention consists in a security system for a metal cabinet door comprising a latch adapted to be locked by a lock and to operate the latching members of the door which comprise upper and lower strip members each having a plurality of hooks each of which, when said door is closed and latched, is engaged in an opening formed in a locking profiled member attached to said cabinet and at least one rotating sector whose rotation axis is perpendicular to the plane of said door and which, when said door is closed and latched, enters an opening in a longitudinal member attached to said cabinet and on the same side as the hinge(s), said sector(s) being operated in the unlatching direction by said latch through a cable and in the latching direction by a return spring.

Preferably said sector passes through an opening in a stiffener attached to said door limiting rotation of said sector in the direction in which is urged by said return spring so that on forcing said hinge(s) the sector is automatically latched in said opening of said longitudinal member attached to said cabinet.

Preferably said hooks of said upper strip member each comprise a heel-piece at its lower end adapted to be hooked into said opening of said locking profiled member if said latch is forced and said upper strip member drops down.

One embodiment of the invention will now be described with reference to the appended drawings.

DETAILED DESCRIPTION OF THE INVENTION

Figure 1:
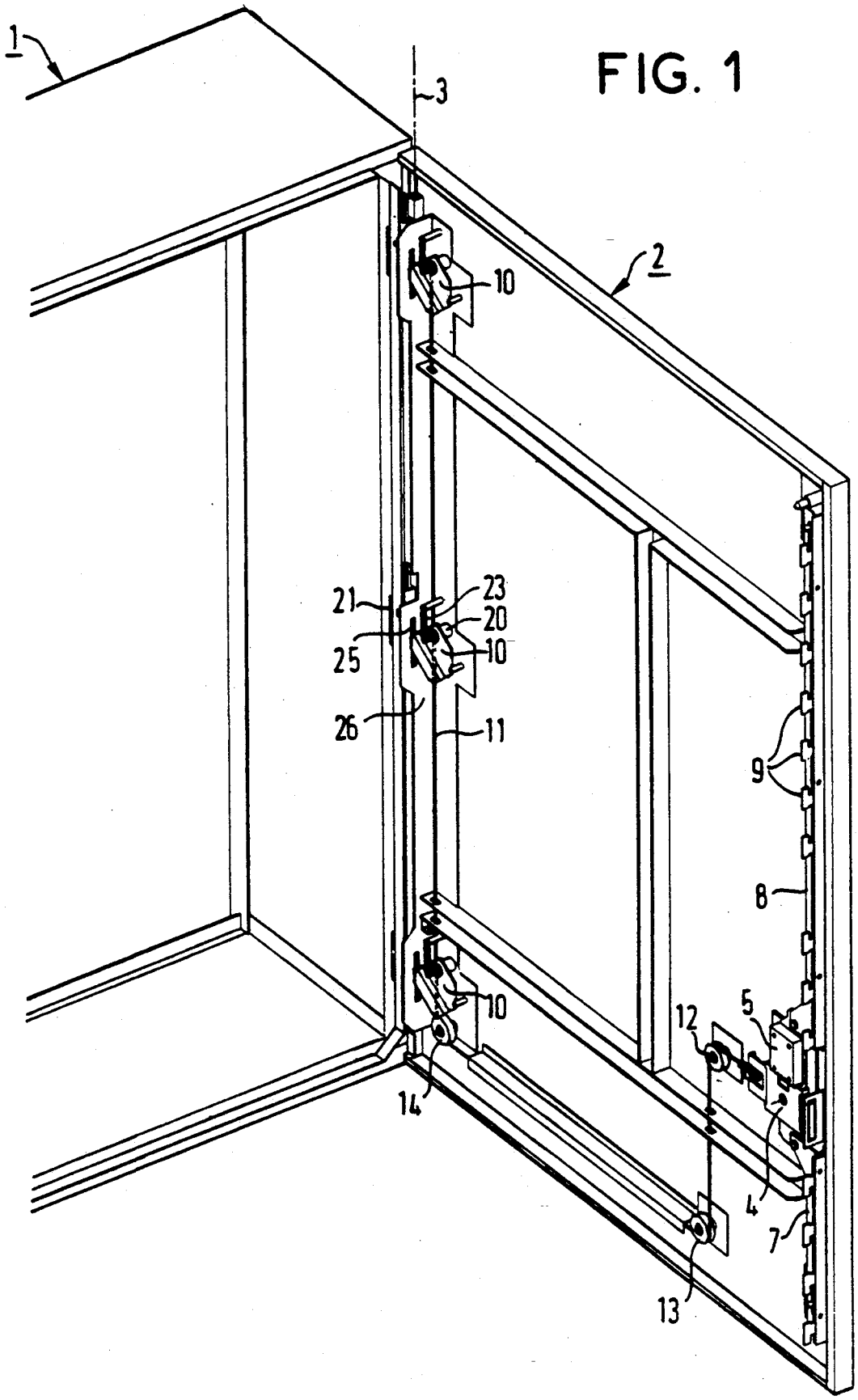
FIG. 1 shows a cabinet fitted with a security system in accordance with the invention with the door open.
Figure 2:
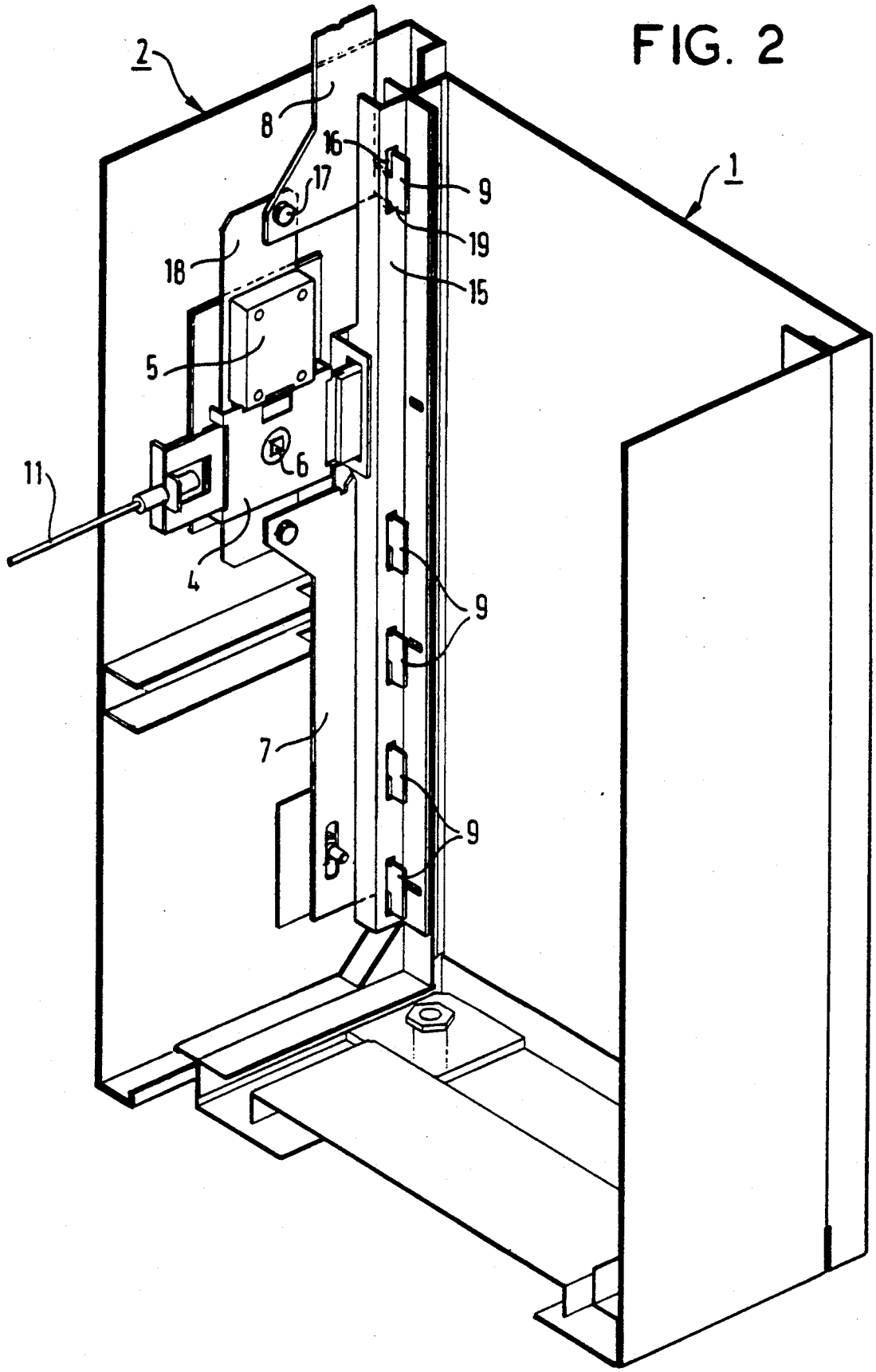
FIG. 2 is a partial view showing part of the door on the side opposite the hinges as seen from inside the cabinet with the door closed but not locked.
Figure 3:
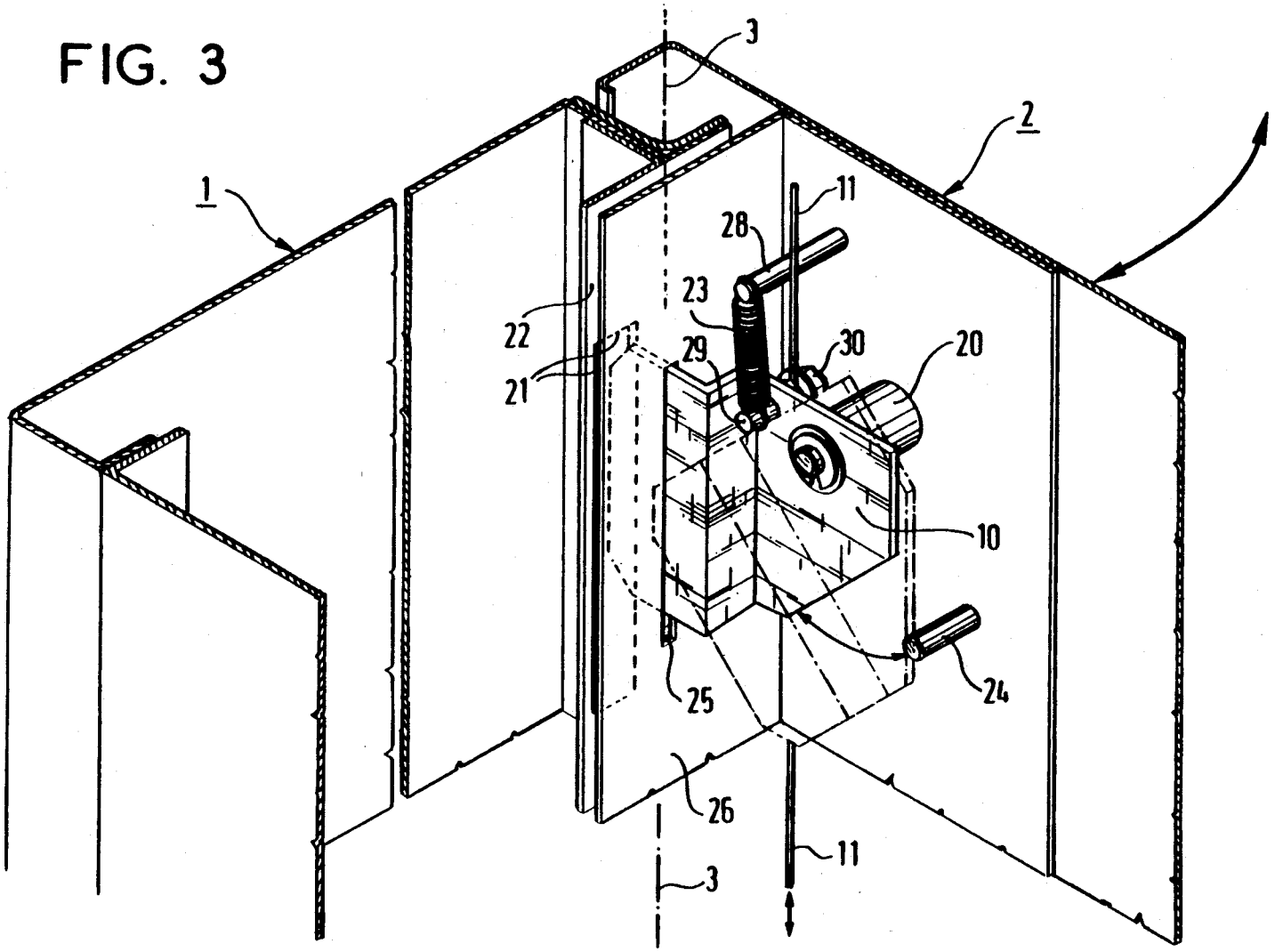
FIG. 3 is a partial view showing part of the door on the same side as the hinges as seen from inside the cabinet with the door closed.

Referring to FIGS. 1, 2 and 3, a metal cabinet 1 has a side-hung door 2 pivoting about a hinge axis 3.

The door 2 is fitted with a latch 4 which can be locked by a lock 5.

The catch 4 incorporates a square operating socket 6 and operates the door latching members.

These latching members comprise a lower strip member 7 and an upper strip member 8 each incorporating a plurality of hooks 9 and, on the same side of the door as the hinge axis 3, three rotating sectors 10. The rotating sectors 10 are linked to the latch 4 by a cable 11 passing around pulley wheels 12, 13 and 14.

The cabinet 1 has on the edge of the opening mating with the side of the door 2 opposite the hinges a locking profiled member 15 incorporating locking openings 16.

When the door is latched by operating the latch 4 via the socket 6 the lower strip member 7 moves downward and the upper strip member 8 moves upward and the hooks 9 engage in the locking openings 16.

If the pin 17 which links the upper strip member to the latch 4 through the intermediary of an operating tang 18 is forced the strip member 8 falls under its own weight and the hooks 9 which incorporate a heel-piece 19 fasten onto the lower edge of the locking openings 16. Thus forcing the pin 17 does not unlatch the corresponding part of the door latching members.

The rotating sectors 10 on the same side of the door as the hinge axis 3 pivot about a pin 20 perpendicular to the plane of the door.

FIG. 3 shows one of these sectors in a position in which the door is closed and latched. The end of the sector 10 enters an opening 21 formed in a longitudinal member 22 attached to the cabinet. The rotating sectors 10 are operated to unlatch the door by pulling the cable 11 on operating the latch 4 in the unlatching direction against return springs 23 which spring-load the sectors 10 in the latching direction.

Each return spring is attached to the cabinet 1 by a pin 28 and to the sector by a pin 29. The pin 29 is extended rearwardly of the sector and used to fix the cable 11 which passes into a hole and is locked between a nut and a locknut 30.

Rotation of the sectors 10 in the opening (unlatching) direction is limited by an abutment member 24 to protect the spring 23.

Figure 4:
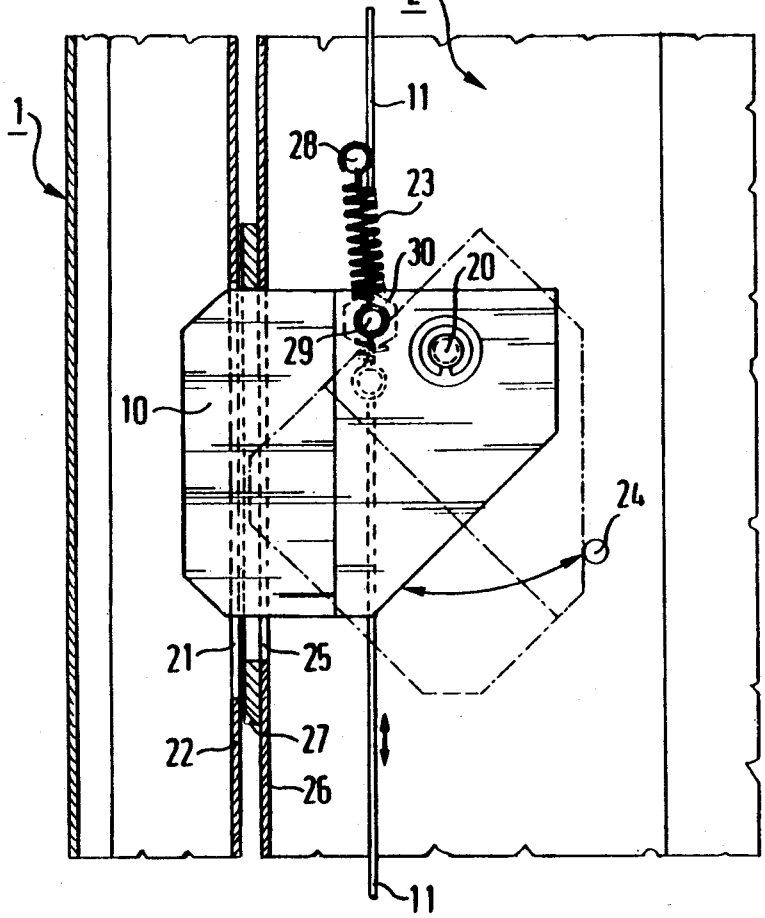
FIG. 4 is a partial view in cross-section showing a rotating sector in the position when the door is closed and latched by the security closure device.

In FIGS. 3 and 4 a sector is shown in the latched position in continuous outline and in the unlatched position in chain-dotted outline.

Rotation of each sector in the latching direction by its return spring 23 is also limited by the upper edge of a slot 25 through which the sector passes in a stiffener 26 attached to the door.

The stiffener 26 is reinforced around the edge of the opening by a plate 27.

Figure 5:
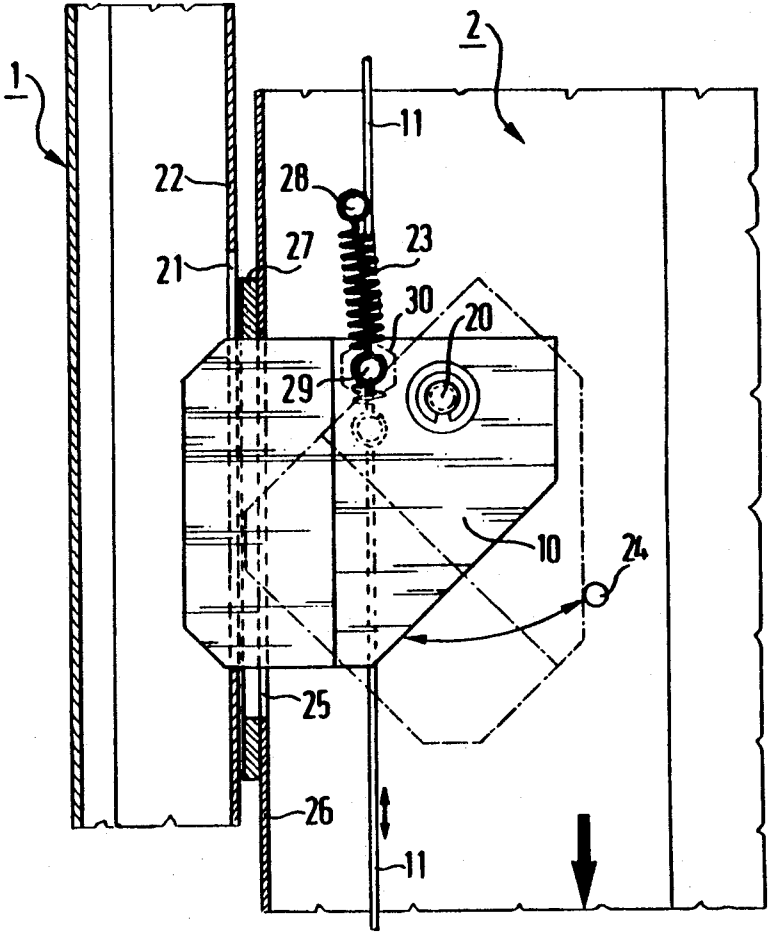
FIG. 5 is a view similar to that of FIG. 4 showing self-locking of the sector in its housing if the door is moved down by forcing its hinges.

If the hinges are forced, the door can drop down slightly but the sectors 10 are automatically latched into the openings 21, abutting against the upper ends of the slots 25 in the member attached to the door. The weight of the door presses them against the lower end of the openings 21 in the longitudinal member 22 of the cabinet (see FIG. 5).

Thus the door cannot be opened by forcing the hinges.

There is claimed:

1. Security system for a hinged metal cabinet door comprising a latch adapted to be locked by a lock and to operate latching members of the door which comprise upper and lower strip members each having a plurality of hooks each of which, when said door is closed and latched, is engaged in an opening formed in a locking profiled member attached to said cabinet and at least one rotating sector whose rotation axis is perpendicular to the plane of said door and which, when said door is closed and latched, enters an opening in a longitudinal member attached to said cabinet, said sector(s) mounted on the same side of said door as the hinge(s), said sector(s) being operated in an unlatching direction by said latch through a cable and in a latching direction by a return spring.

2. System according to claim 1 wherein said sector passes through an opening in a stiffener attached to said door limiting rotation of said sector in the direction in which is urged by said return spring so that on forcing said hinge(s) said sector is automatically latched in said opening of said longitudinal member attached to said cabinet.

3. System according to claim 1 wherein said hooks of said upper strip member each comprise a heel-piece at its lower end adapted to be hooked into said opening of said locking profiled member if said latch is forced and said upper strip member drops down.

* * * * *